US005368000A

United States Patent [19]

Koziara

[11] Patent Number: 5,368,000

[45] Date of Patent: Nov. 29, 1994

[54] ENGINE EFFICIENCY IMPROVEMENT SYSTEM

[75] Inventor: Robert P. Koziara, Lake Elmo, Minn.

[73] Assignee: Onan Corporation, Minneapolis, Minn.

[21] Appl. No.: 92,136

[22] Filed: Jul. 15, 1993

[51] Int. Cl.[5] ..... F02D 41/04; F02D 17/02

[52] U.S. Cl. ..... 123/481; 123/192.2

[58] Field of Search ..... 123/481, 198 F, 192.1, 123/192.2

[56] References Cited

U.S. PATENT DOCUMENTS

| | | | |
|---|---|---|---|
| 322,310 | 7/1885 | Miles . | |
| 1,011,778 | 12/1911 | Harhorn . | |
| 1,179,779 | 4/1916 | Uhl . | |
| 1,749,883 | 11/1926 | Ledwinka . | |
| 1,784,133 | 12/1930 | Decker . | |
| 1,893,629 | 1/1933 | Masterson et al. . | |
| 2,137,738 | 11/1938 | Faubion . | |
| 2,153,523 | 4/1939 | Roberts et al. . | |
| 2,256,035 | 9/1941 | Potter . | |
| 2,383,996 | 9/1945 | Stucke . | |
| 2,462,182 | 2/1949 | Guerdan et al. . | |
| 2,564,741 | 8/1951 | Vermillion . | |
| 2,955,750 | 10/1960 | Phelps | 123/192.2 |
| 3,185,876 | 5/1965 | Broziat | 310/77 |
| 3,842,287 | 10/1974 | Nakamura | 290/16 |
| 4,056,746 | 11/1977 | Burtis | 310/115 |
| 4,084,445 | 4/1978 | Erwin | 74/61 |
| 4,098,252 | 7/1978 | Abthoff et al. | 123/198 F |
| 4,099,589 | 7/1978 | Williams | 180/65 A |
| 4,172,434 | 10/1979 | Coles | 123/481 |
| 4,195,613 | 4/1980 | Bratt et al. | 123/192.2 |
| 4,274,382 | 6/1981 | Sugasawa et al. | 123/481 |
| 4,291,233 | 9/1981 | Kirschbaum | 290/1 C |
| 4,382,188 | 5/1983 | Cronin | 290/1 C |
| 4,425,989 | 1/1984 | Gotoda | 192/48.92 |
| 4,489,695 | 12/1984 | Kohama et al. | 123/481 |
| 4,496,020 | 1/1985 | Mitsuishi | 180/219 |
| 4,535,744 | 8/1985 | Matsumura | 123/481 X |
| 4,538,481 | 9/1985 | Ohta et al. | 74/603 |
| 4,556,026 | 12/1985 | Masuda et al. | 123/198 F |
| 4,608,952 | 9/1986 | Morita et al. | 123/198 F |
| 4,628,876 | 12/1986 | Fujikawa et al. | 123/192.2 |
| 4,699,097 | 10/1987 | Tanaka et al. | 123/192.1 |
| 4,722,308 | 2/1988 | Wall | 123/198 F |
| 4,900,992 | 2/1990 | Sekizawa | 318/135 |
| 4,963,804 | 10/1990 | Geiger | 318/460 |
| 4,984,480 | 1/1991 | Gormley | 74/573 R |
| 5,038,731 | 8/1991 | Shimada | 123/192.2 |
| 5,057,725 | 10/1991 | Kasai et al. | 310/51 |
| 5,057,726 | 10/1991 | Mole et al. | 310/67 R |
| 5,087,230 | 2/1992 | Yates et al. | 475/151 |
| 5,105,776 | 4/1992 | Tsuchiya et al. | 123/192.1 |

FOREIGN PATENT DOCUMENTS

| | | |
|---|---|---|
| 637117 | 2/1962 | Canada . |
| 886890 | 11/1971 | Canada . |
| 920454 | 2/1973 | Canada . |
| 920455 | 2/1973 | Canada . |
| 920456 | 2/1973 | Canada . |
| 920457 | 2/1973 | Canada . |
| 920458 | 2/1973 | Canada . |
| 1210245 | 10/1970 | United Kingdom . |
| 1210246 | 10/1970 | United Kingdom . |
| 1210247 | 10/1970 | United Kingdom . |
| 1210248 | 10/1970 | United Kingdom . |
| 1210249 | 10/1970 | United Kingdom . |
| 1210250 | 10/1970 | United Kingdom . |

OTHER PUBLICATIONS

"The Vibrationless Engine" published in Automobile Engineer, Aug., 1970 (Exhibit A).

*Primary Examiner*—Willis R. Wolfe

*Attorney, Agent, or Firm*—Merchant, Gould, Smith, Edell, Welter & Schmidt

[57] ABSTRACT

A multiple-cylinder combustion engine includes a counter rotating system eliminating any vibratory pitch, yaw, and roll torques. The net angular momentum of all rotating parts in the engine is equal to zero. The multiple-cylinder combustion engine activates or deactivates the number of the cylinders without any additional pitch, yaw, and roll torques.

9 Claims, 4 Drawing Sheets

ENGINE EFFICIENCY IMPROVEMENT SYSTEM

BACKGROUND OF THE INVENTION

The present invention relates to an engine efficiency improvement system. More particularly, the present invention relates to efficiently operating a combustion engine with multiple cylinders by deactivating some of the cylinders when the engine is operated under a light load.

The combustion engines have been commercially manufactured for many decades in automobiles, generator sets, compressors, pumps, welders, and even hybrid electric vehicles. One increasingly important concern in the aforementioned engine applications and other engine applications requiring frequent part load power output is maximizing fuel economy. The most common and the least inefficient means of reducing engine power is to reduce the throttle opening. This reduced throttle opening results in a high intake manifold vacuum condition and correspondingly high air pumping losses as each cylinder is trying to draw air through a significantly restricted throttle opening.

The present invention is to deactivate cylinders which are not required to produce the part load power of the engine when the machine, pump, compressor, welder, and automobile, etc. do not require full power.

Cylinder deactivation to reduce power is a well-known practice that goes back to the early years of engine production. In every instance, however, no successful attempt has been made to eliminate the corresponding vibrations which are caused by deactivating some cylinders. The vast differences in pitch, yaw, roll torques are imposed on the engine/machine by the imbalance in power impulse energy between the firing and non-firing cylinders. This effect can be clearly demonstrated by disconnecting one or more spark plug wires on a conventional engine. The shaking is pronounced and objectionable particularly when all but one cylinder are deactivated.

The present invention provides a multiple cylinder combustion engine under a condition of either activating or deactivating any determined number of the cylinders when the engine is operated either under a light load or under a heavy load. In the present invention, when the engine has a light load, some of the cylinders can be deactivated without any additional vibrations, and the rest of cylinders still provide sufficient power to maintain the pre-selected running speed of the engine. In addition, the present invention avoids the pumping losses wherein a throttle plate of the cylinders is widely opened.

SUMMARY OF THE INVENTION

The present invention relates to an engine efficiency improvement system.

The present invention eliminates the aforementioned vibration problem by incorporating a counter rotating system which results in the net angular momentum of all rotating parts in the engine is zero. The zero net angular momentum cancels all pitch, yaw, and roll torques, which are generally produced by the crankshaft rotating system, regardless of the number of firing cylinders.

The present invention does not alter the rotational balance of an engine regardless of the engine balance scheme. The present invention can utilize an existing counter-rotating shaft, which may be part of an existing engine balance scheme, by adjusting the angular momentum of the engine balance scheme to match that of the crankshaft rotating system.

One embodiment of the engine efficiency improvement system in accordance with the principles of the present invention, comprises:

a crankshaft being driven by a plurality of cylinders of the combustion engine;

electronic engine control means for activating and deactivating any one of the cylinders without any additional pitch, yaw and roll torques, the electronic engine control means being electrically connected to a plurality of individual fuel system for each cylinder;

a balance shaft being positioned on the engine parallel to the crankshaft; and gear means, engaging with the balance shaft and the crankshaft, for counter-rotating the balance shaft and the crankshaft in an opposite direction, a net angular momentum of all rotating parts in the combustion engine is zero.

In one embodiment, after the electronic engine control system deactivates some of the cylinders, a throttle angle of a throttle plate of each of the remaining cylinders is significantly increased by a throttle actuator control system to allow the remaining cylinders to provide sufficient power so as to maintain the pre-selected speed. In addition, the widely opened throttle significantly reduces the pumping losses in the present invention.

In one embodiment, any number of cylinders can be fired in the engine without any pitch, yaw, and roll torques, and any number of cylinders can be activated or deactivated without any additional pitch, yaw and roll torques. The net angular momentum of the rotating parts in the engine is always zero.

These and various other advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE PREFERRED EMBODIMENT

Figure 1:
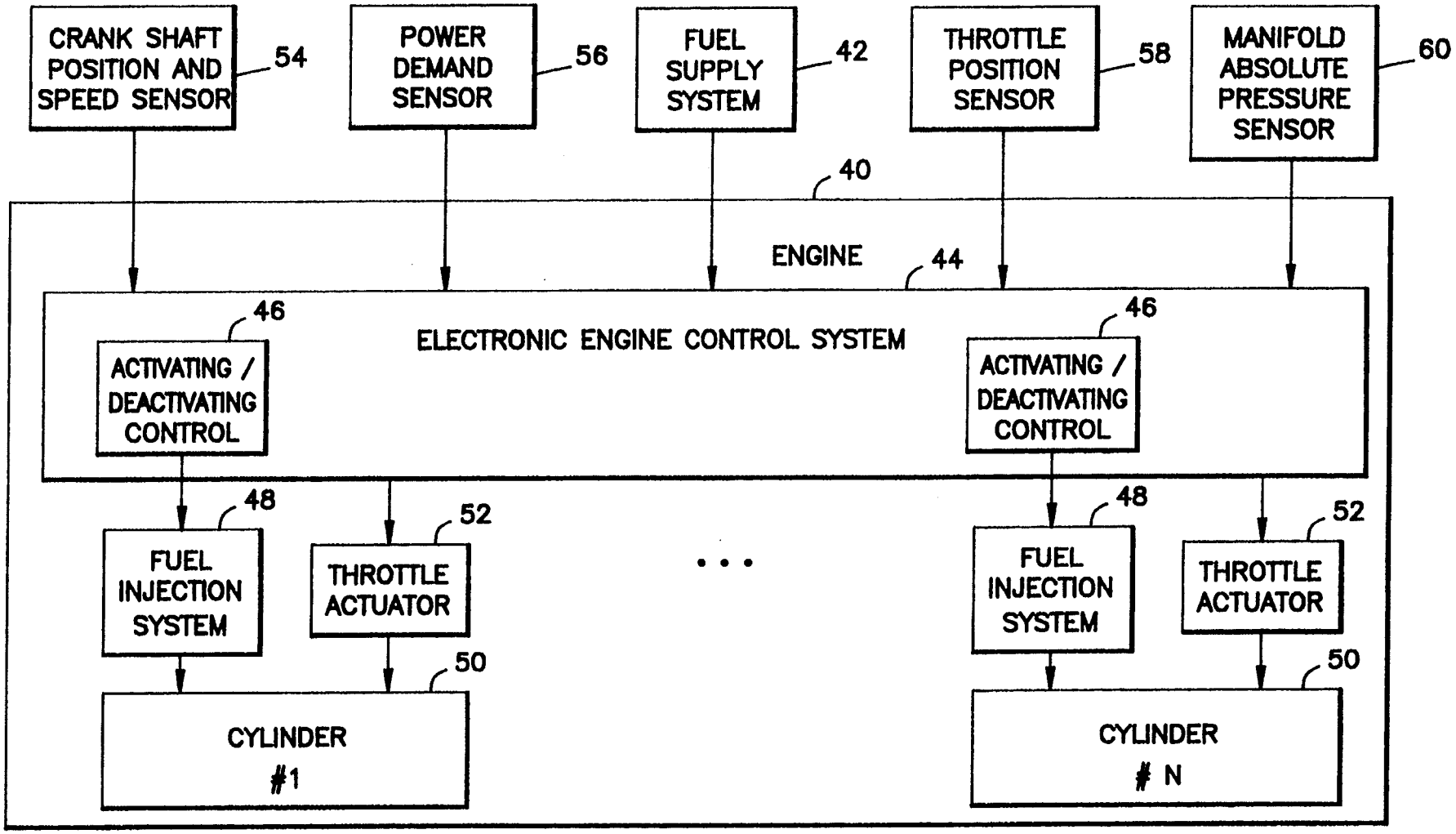
FIG. 1 is a block diagram of a vibrationless multiple cylinder combustion engine having an electronic engine control system controlling the activation and deactivation of multiple cylinders in accordance with the principles of the present invention.

In FIG. 1, there is shown a block diagram of a vibrationless multiple cylinder combustion engine 40 generally in accordance with the principles of the present invention. The combustion engine 40 is equipped with a fuel supply system 42 and has an electronic engine control system 44 controlling the firing of any number of cylinders.

The electronic engine control system 44 includes a plurality of activating/deactivating control units 46, each of which controls activation and deactivation of a fuel injection system 48 of corresponding cylinder 50. After the electronic engine control system 44 detects a required speed and load condition, an electric signal will be sent to the fuel injection system 48 which then activates or deactivates the firing of the cylinder 50.

The electronic engine control system 44 also controls a throttle actuator 52 of the cylinder 50. After the electronic engine control system 44 detects a required speed and load condition, an electric signal will be sent to the throttle actuator 52 which adjusts a throttle angle of a plate 53 (shown in FIG. 2) to an optimized throttle opening position.

The electronic engine control system 44 determines the minimum number of cylinders and an optimized throttle opening position by a plurality of sensors, such as a crankshaft position and speed sensor 54, a power demand sensor 56, a throttle position sensor 58, and a manifold absolute pressure sensor 60. The crankshaft position and speed sensor 54 and the power demand sensor 56 sense the engine speed and engine power requirements and sends the information to the electronic engine control system 44. The throttle position sensor 58 and the manifold absolute pressure sensor 60 sense the present air flow volume and air flow pressure and send information to the electronic engine control system 44. Consequently, the electronic engine control system 44 determines a minimum number of cylinders and an optimized throttle position. The electronic engine control system 44 sends an electric signal to the throttle actuator 52, and the activating/ deactivating control units 46 send the electric signals to the fuel injection system 48.

Figure 2:
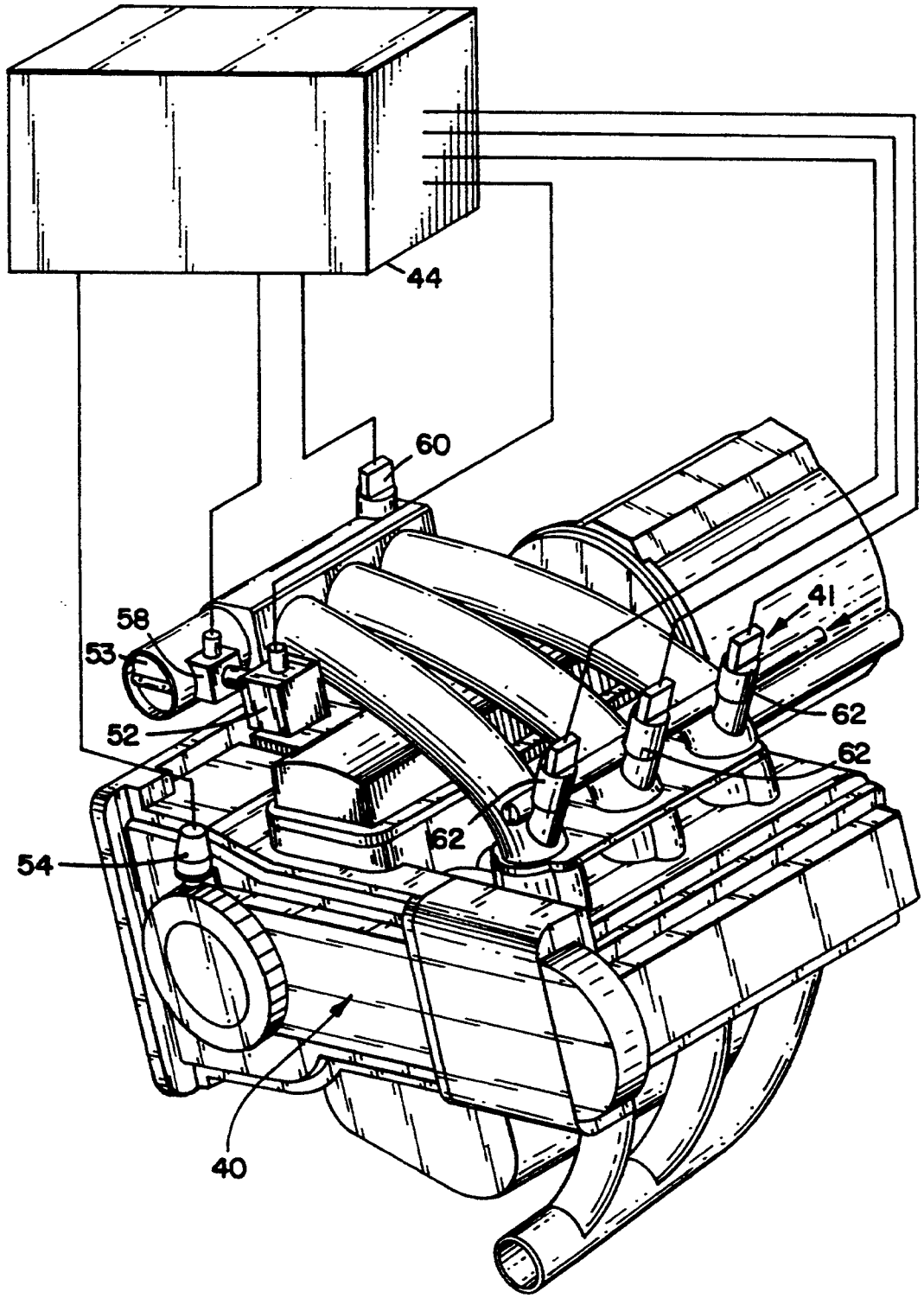
FIG. 2 is a perspective view of the vibrationless multiple cylinder combustion engine having the electronic engine control system.

In FIG. 2, the electronic engine control system 44 is electrically connected to the crankshaft position and speed sensor 54, the throttle position sensor 58, and the manifold absolute pressure sensor 60. The electronic engine control system 44 also electrically connected to the fuel injection system 48 having a plurality of fuel nozzles 62. Three cylinder combustion engine is used in the present invention. It is appreciated that any number of cylinder combustion engine can be used in accordance with the principles of the present invention. Accordingly, three fuel nozzles are used in the preferred embodiment.

Figure 3:
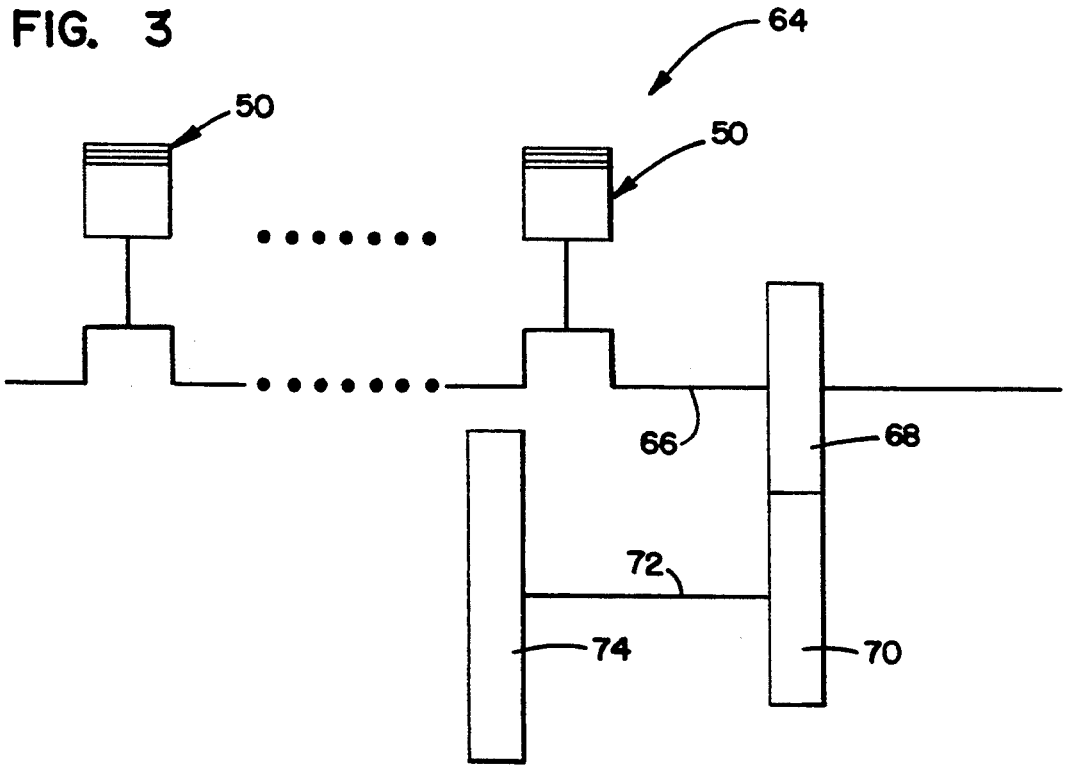
FIG. 3 is a generic counter rotating system in the vibrationless multiple cylinder combustion engine.

FIG. 3 generically shows a counter rotating system 64. The cylinders 50 drive an engine crankshaft 66. A gear 68 mounted on the crankshaft 66 engages with a gear 70 which is mounted on a balance shaft 72. The engagement of the two gears causes the balance shaft 72 to rotate in opposite directions of the crankshaft 66 so that the net angular momentum is zero. It is appreciated that any other types of counter rotating mechanism can be used with the crankshaft 66 so as to eliminate any pitch, yaw, and roll torques, and thus the net angular momentum of all rotating parts of the combustion engine 40 is zero.

Any type of counterweights (not shown) can be mounted on the crankshaft 66 if necessary. In addition, if necessary, any type of flywheel 74 or counterweight can be mounted on the balance shaft 72. Alternatively, a generator, welder, and compressor (not shown) can be interconnected to the balance shaft 72 or the crankshaft 66. In all cases, there are no vibratory pitch, yaw, and roll torques because the net angular momentum is equal to zero. In addition, since the net angular momentum is zero, the firing of the cylinders, or the deactivating or the activating of the cylinders 50 will not cause any additional vibrations. Thus, when the sensors sense a light load, the combustion engine 40 can deactivate some of the cylinders 50 so as to reach a most efficient engine operation without any additional vibrations. Thus, the combustion engine 40 can fire any number of cylinders if required or if necessary so that the combustion engine 40 can fire a single cylinder 50 if necessary.

Figure 4:
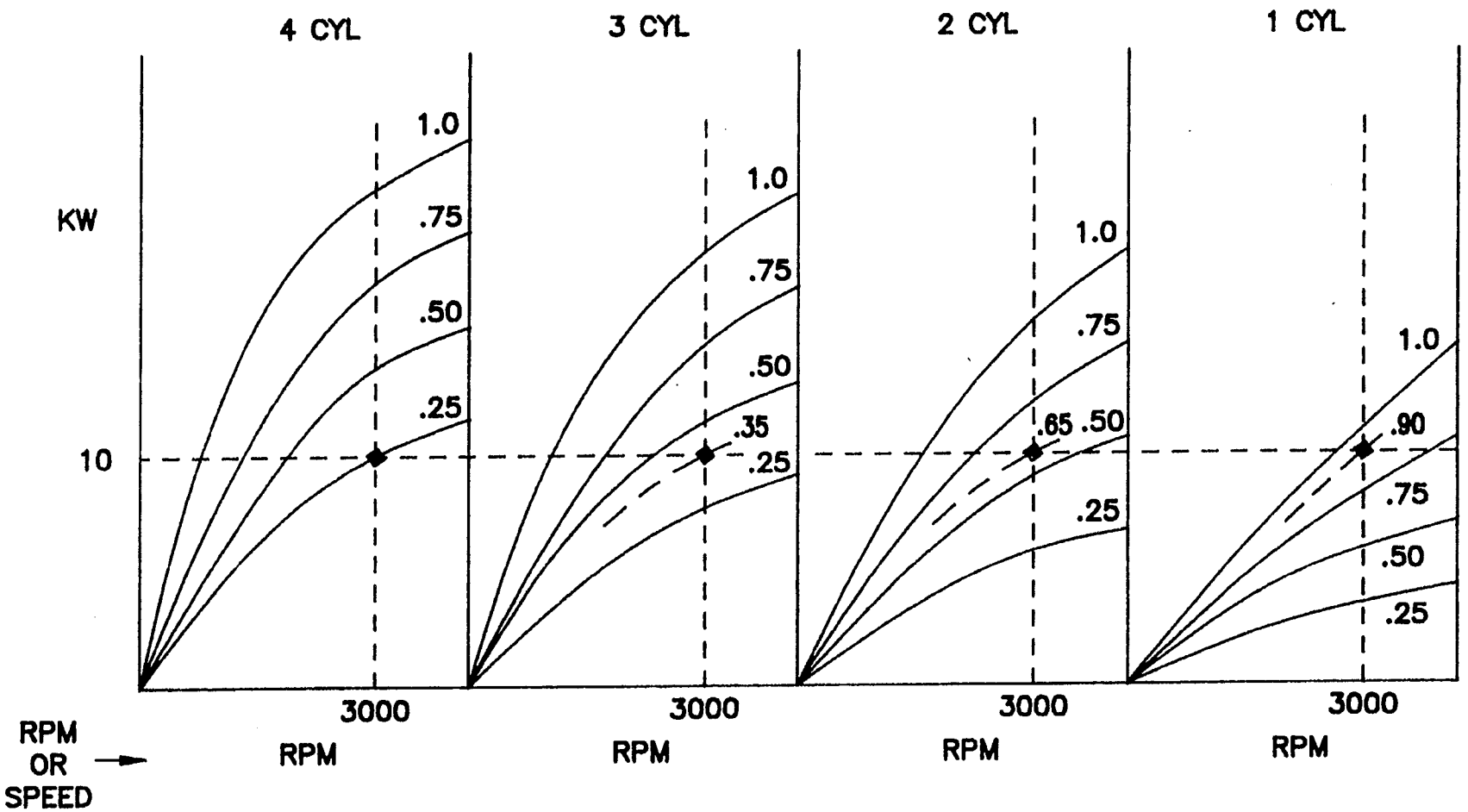
FIG. 4 is a graph showing optimized throttle positions of different number of activating or firing cylinders.

FIG. 4 shows a graph of a four-cylinder engine as an example. The graphic lines show different throttle plate opening percentages corresponding to the engine output power at various speeds (RPM) for firing four, three, two, and one cylinders in the four-cylinder engine.

The diamond points on the graph lines in FIG. 4 are shown as an example of optimizing different throttle plate opening percentage in different number of cylinders under the same speed and the same power output. As shown, in order to produce 3000 RPM and 10 KW, if firing four cylinders, 25% of the throttle plate opening is required; if firing three cylinders, 35% of the throttle plate opening is required; if firing two cylinders, 65% of the throttle plate opening is required; and if firing one cylinder, which is the most fuel efficient operating mode, 90% opening of the throttle plate is required. Thus, when there is no load or a very light load, the four-cylinder engine can deactivate three of the cylinders, which can still maintain the sufficient power output.

In operation, upon startup of the multiple combustion engine 40, either automatically operating at a predetermined speed or manually setting a speed, the electronic engine control system 44 senses a throttle opening position, and/or absolute intake manifold pressure, and the crankshaft speed. If the sensors detect that there is no load taken from an engine driven device 41, the engine 40 will operate at its pre-determined speed. At this condition, the electronic engine control system 44 will access its RAM (Random Access Memory) and determine the minimum number of cylinders and corresponding optimized throttle plate opening position. Electric signals are sent to the fuel injection system 48 and the throttle actuator 52. Thus, a minimum number of cylinder(s) efficiently operate(s) the engine 40.

On the other hand, if there is a large load imposed on the driven device 41, the electronic engine control system 44 will sense the requirement by the sensors and instruct the fuel injection system 48 to fire more cylinders and instruct the throttle actuator 52 to increase the throttle opening percentage.

As mentioned before, no additional vibrations are created by firing or activating or deactivating any number of cylinders so that optimizing the fuel economy is accomplished by the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A combustion engine having a plurality of cylinders and a throttle system, comprising:

a crankshaft being driven by the cylinders of the combustion engine;

electronic engine control means for activating and deactivating any one of the cylinders, the electronic engine control means being electrically connected to the individual fuel system for each cylinder;

a balance shaft being positioned on one side of the crankshaft; and gear means, engaging with the balance shaft and the crankshaft, for counter-rotating the balance shaft and the crankshaft in an opposite direction, a net angular momentum of all rotating parts in the combustion engine is zero.

2. A combustion engine in accordance with claim 1, wherein the gear means includes a first gear being mounted on the crankshaft and the second gear being mounted on the balance shaft.

3. A combustion engine in accordance with claim 1, wherein a counterweight is mounted on the crankshaft.

4. A combustion engine in accordance with claim 1, wherein a counterweight is mounted on the balance shaft.

5. A combustion engine in accordance with claim 1, wherein the electronic engine control means includes activating/deactivating control means for controlling fuel supply, the activating/deactivating control means being electrically interconnected with fuel injection means for supplying fuel mixture to the individual cylinders.

6. A combustion engine in accordance with claim 1, wherein the electronic engine control means being interconnected with throttle actuating means for adjusting a throttle opening position.

7. A combustion engine in accordance with claim 1, further comprising crankshaft position and speed sensor means for sensing position of the crankshaft and speed of the crankshaft, the crankshaft position and speed sensor means being interconnected with the crankshaft.

8. A combustion engine in accordance with claim 1, further comprising a throttle position sensor means for sensing a throttle opening position of a throttle plate, the throttle position sensor means being mounted in the throttle system.

9. A combustion engine in accordance with claim 1, further comprising a manifold absolute pressure sensor means for sensing air pressure in the induction system, the manifold absolute pressure sensor means being mounted on the induction system.

* * * * *